US011401674B2

(12) United States Patent
Gao et al.

(10) Patent No.: US 11,401,674 B2
(45) Date of Patent: Aug. 2, 2022

(54) PILE-BOTTOM GROUTING CAVITY AND METHOD FOR USING SAME, AND CAST-IN-PLACE PILE BODY AND METHOD FOR CONSTRUCTING SAME

(71) Applicants: Yunfei Gao, Beijing (CN); Yongguang Gao, Beijing (CN)

(72) Inventors: Yunfei Gao, Beijing (CN); Yongguang Gao, Beijing (CN)

( * ) Notice: Subject to any disclaimer, the term of this patent is extended or adjusted under 35 U.S.C. 154(b) by 53 days.

(21) Appl. No.: 17/041,226

(22) PCT Filed: Jun. 28, 2019

(86) PCT No.: PCT/CN2019/093599
§ 371 (c)(1),
(2) Date: Sep. 24, 2020

(87) PCT Pub. No.: WO2020/133992
PCT Pub. Date: Jul. 2, 2020

(65) Prior Publication Data

US 2021/0010218 A1 Jan. 14, 2021

(30) Foreign Application Priority Data

Dec. 25, 2018 (CN) ..... 201811586047.5

(51) Int. Cl.
*E02D 5/34* (2006.01)
*E02D 5/62* (2006.01)
*E02D 15/04* (2006.01)

(52) U.S. Cl.
CPC ..... *E02D 5/34* (2013.01); *E02D 5/62* (2013.01); *E02D 15/04* (2013.01); *E02D 2250/0023* (2013.01)

(58) Field of Classification Search
CPC combination set(s) only.
See application file for complete search history.

(56) References Cited

U.S. PATENT DOCUMENTS

2019/0368622 A1* 12/2019 Kang ..... F16K 15/026

FOREIGN PATENT DOCUMENTS

CN 2568695 Y 8/2003
CN 203411979 U 1/2014
(Continued)

OTHER PUBLICATIONS

European Patent Office; Search Report of corresponding EP Application No. EP19901429.1; dated Jun. 22, 2021; pp. 1-4.
(Continued)

*Primary Examiner* — Kyle Armstrong
(74) *Attorney, Agent, or Firm* — Taft Stettinius & Hollister LLP; Stephen F. Rost

(57) ABSTRACT

Disclosed are a pile-bottom grouting cavity and a method for using same, and a cast-in-place pile body and a method for constructing same. The pile-bottom grouting cavity comprises: a grouting capsule, having an expansion state in which the grouting capsule is filled with grout to bear a pile body, and a contracted state in which the grouting capsule is hollow; a grouting pipe in communication with an inner cavity of the grouting capsule to grout the grouting capsule; and a fixing plate, with the grouting capsule being arranged on the fixing plate, and the fixing plate being provided with a through hole that is in communication with the bottom of an accommodation hole, such that slurry and/or sediment in the accommodation hole pass through the fixing plate. The aim thereof is to solve the problems in the prior art of hole wall collapse and excessive sediment that seriously affect the quality of construction in a grouting pile with a grouting capsule during the construction of a cast-in-place bored pile.

18 Claims, 4 Drawing Sheets

(56) References Cited

FOREIGN PATENT DOCUMENTS

| | | | | | |
|---|---|---|---|---|---|
| CN | 103741683 | B | | 11/2015 | |
| CN | 105178324 | A | | 12/2015 | |
| CN | 106759277 | A | | 5/2017 | |
| CN | 106836179 | A | | 6/2017 | |
| CN | 108265720 | A | | 7/2018 | |
| CN | 108411920 | A | | 8/2018 | |
| CN | 109056716 | A | | 12/2018 | |
| CN | 109469050 | A | | 3/2019 | |
| CN | 210395360 | U | | 4/2020 | |
| JP | 2001214438 | A | | 8/2001 | |
| JP | 2003171930 | A | | 6/2003 | |
| JP | 4758463 | B2 | | 8/2011 | |
| JP | 2017128875 | A | | 7/2017 | |
| KR | 20120055835 | A | * | 6/2012 | ..... E02D 13/10 |
| KR | 2021009509 | A | * | 1/2021 | ..... E02D 5/80 |
| WO | WO-2014147349 | A1 | * | 9/2014 | ..... E02D 5/80 |
| WO | 2020024740 | A1 | | 2/2020 | |
| WO | 2020133992 | A1 | | 7/2020 | |

OTHER PUBLICATIONS

European Patent Office; First Office Action of corresponding EP Application No. 19901429.1; dated Jul. 16, 2021; pp. 1-7.

The Patent Office, Intellectual Property India; First Office Action of corresponding IN Application No. 202037054469; dated Aug. 17, 2021; pp. 1-5.

International Search Report & Written Opinion, PCT/2019/093599, China National Intellectual Property Administration, dated Oct. 8, 2019, 7 pages.

Notification of First Office Action, Application No. 2016800288567, China National Intellectual Property Administration, dated Sep. 25, 2020, 6 pages.

International Search Report and Written Opinion of the ISA/China with Translation of the International Search Report; dated Oct. 8, 2019.

European Patent Office (EPO) Munich, Germany; Third Office Action of corresponding EP Application 19901429.1 dated May 24, 2022; pp. 1-5.

* cited by examiner

PILE-BOTTOM GROUTING CAVITY AND METHOD FOR USING SAME, AND CAST-IN-PLACE PILE BODY AND METHOD FOR CONSTRUCTING SAME

This application is a U.S. national stage application tinder 35 U.S.C. § 371 of PCT International Application Serial No. PCT/CN2019/093599, which has an international filing date of Jun. 28, 2019, designates the United States of America, and claims the benefit of CN201811586047.5, which was filed on Dec. 25, 2018, the disclosures of which are hereby expressly incorporated by reference in their entirety.

TECHNICAL FIELD

The application relates to the technical field of ground foundation, in particular to a pile-bottom grouting cavity and application method thereof, a cast-in-place pile body and construction method thereof.

BACKGROUND

At present, in the ground foundation field, an open grouting technique is commonly used in the post-grouting for cast-in-situ pile. However, the open grouting has the problem of low controllability of the grout injection area, and small increase in formation of an enlarged head of the pile end, a compaction effect on the surrounding formation, and a bearing capacity of the pile end.

In order to solve the problem of the open grouting, a grouting pile grouting device having a grouting capsule is disclosed in the prior art, which includes a grouting pipe, a steel bottom plate, a grouting access opening, and a grouting capsule. The grouting access opening extends above and below the steel bottom plate, and the upper portion of the grouting access opening is connected to the grouting pipe, and the lower portion of the grouting access opening is connected to the grouting capsule located at a lower portion of the steel bottom plate; and the upper portion of the grouting pipe is connected to a grouting pump.

However, during the construction of a cast-in-place bored pile, especially during the construction process of using slurry protection, the above-mentioned grouting pile with grouting capsules have obvious defects. When the steel plate with the grouting capsule is installed at the bottom of the rebar cage as a post grouting container, the rebar cage with a protective steel plate acts like a piston in the borehole during the process of sinking the rebar cage to the bottom of the hole, and causes difficulty in discharging the slurry upwards in the borehole and cause vortex in the slurry water that damage the hole wall, causing the slurry water circling between the steel plate edge and the borehole wall to scour and simultaneously disturb the borehole wall, causing the borehole wall to collapse. In addition, the above steel bottom plate will also scrape the borehole wall, which will further aggravate the collapse of the borehole wall. The collapse of the borehole wall causes the sediment at the bottom of the borehole which has been cleaned to exceed the standard after the grouting container sinks to the bottom, and at the same time, slurry and sand collapsed from the borehole wall will be accumulated at an upper part of the steer bottom plate to exceed the standard, seriously affecting the quality of the cast-in-place bored pile, and even causing the problem of broken pile.

SUMMARY

Therefore, the present application is intended to provide a pile-bottom grouting cavity and application method thereof, a cast-in-place pile body and construction method thereof to solve the problem in the prior art that the grouting pile with grouting capsules cause collapse of the borehole wall and sediment to exceed the standard.

Therefore, the present application provides a pile-bottom grouting cavity, which comprises:

a grouting capsule, having an expansion state in which an interior of the grouting capsule is filled with grout to bear a pile body, and a contracted state in which an interior of the grouting capsule is hollow;

a grouting pipe communicating with an inner cavity of the grouting capsule for grouting the grouting capsule, and a fixing plate, provided with the grouting capsule thereon and a through hole therethrough, wherein the through hole communicates with a bottom of a accommodation hole for allowing slurry and/or sediment within the accommodation hole to pass through the through hole of the fixing plate.

A through hole is provided at a center of the fixing plate, wherein the fixing plate comprises an annular plate structure.

The grouting capsule comprises a hollow annular structure matching the annular plate structure of the fixing plate.

The fixing plate is annular and provided with an annular stopper extending to an inner ring of the grouting capsule at an inner ring edge of the fixing plate.

A height value of the annular stopper is not greater than the sum of a predetermined thickness value of the sediment within the accommodation hole and a thickness of the grouting capsule.

The annular stopper is perpendicular to a surface of the fixing plate.

The pile-bottom grouting cavity further comprises a first check valve, provided at a communication position between the grouting pipe and the grouting capsule to prevent plugs within the grouting capsule from entering the grouting pipe.

The grouting pipe is provided with a first grouting hole for allowing the grout to enter the grouting capsule, and the first check valve comprises a first elastic member oppositely disposed to the first grouting hole of the grouting pipe to seal the first grouting hole, wherein the first elastic member comprises a sealed state in which the first elastic member is in close contact with the grouting pipe to prevent the plugs from entering the grouting pipe through the first grouting hole, and an opened state in which the first elastic member is moved by a pressure from the grouting pipe in a direction away from the grouting pipe so that the grout can pass through the first grouting hole into the grouting capsule.

The grouting pipe comprises a first grouting portion extending into the inner cavity of the grouting capsule, and the first grouting portion comprises an annular tube extending along an outer contour of the fixing plate, and the first elastic member comprises an annular bushing sleeved on the first grouting portion.

The pile-bottom grouting cavity further comprises a grout replenishing structure communicating with the through hole for grouting into the through hole.

The grout replenishing structure comprises at least one grout replenishing tube which communicates with the through hole for grouting into the through hole.

The grout replenishing tube comprises a second grouting portion extending into a cavity of the through hole and is provided with a plurality of second grouting holes, and the second grouting portion is an arcuate tube extending along a hole wall contour of the through hole.

The second grouting portion comprises an annular pipe extending along the contour of the hole wall of the through hole.

The fixing plate comprises a grout-storage chamber communicating with the through hole, and the grout replenishing tube communicates with a grout inlet of the grout-storage chamber.

The grout replenishing tube is provided with a second check valve which controls a communicating state or a cutoff state between the grout replenishing tube and the through hole.

The second check valve comprises: a second elastic member, oppositely disposed to the grouting hole of the grout replenishing tube to seal the second grouting hole. The second elastic member comprises a sealed state in which the second elastic member is in close contact with grout replenishing tube to prevent the plugs from entering grout replenishing tube through the second grouting hole, and an opened state in which the second elastic member is moved by a pressure from the grout replenishing tube in a direction away from the grout replenishing tube so that the grout can pass through the second grouting hole into the through hole.

The second elastic member comprises an annular bushing sleeved on the second grouting portion.

A through hole is provided at a center of the fixing plate, wherein, the fixing plate comprises an annular plate structure, wherein, the fixing plate is provided with an annular stopper extending to an inner ring of the grouting capsule at the inner ring edge of the fixing plate, and the second grouting hole of the grout replenishing tube is located on a side of the annular stopper away from the fixing plate.

The grouting capsule is provided with a capsule detection port for filling a medium therein.

The capsule detection port is arranged on the fixing plate.

A cast-in-place pile body comprises a pile-bottom grouting cavity according to any one of claims 1 to 20; and a rebar cage, connected to the fixing plate of the pile-bottom grouting cavity, wherein, the grouting pipe is fixedly connected to the rebar cage.

The cast-in-place pile body further comprises a pile-side grouting pipe fixed on the rebar cage, wherein a first grouting hole of the pile-side grouting pipe is arranged at a position near the grouting capsule for grouting toward a pile-side formation.

A method for constructing a cast-in-place pile body comprises the following steps:

S1, forming an accommodation hole and cleaning a sediment within the accommodation hole;

S2, sinking the rebar cage with the pile-bottom grouting cavity mounted at the lower end of the rebar cage to the bottom of the accommodation hole;

S3, discharging the sediment below the fixing plate through the through hole;

S4, grouting concrete into the accommodation hole to form a grouting pile; and S5, grouting into the grouting capsule to form an enlarged head at the bottom of the pile.

In the method for constructing a cast-in-place pile body, step S3 specifically comprises controlling a negative pressure suction pipe to align with the through hole, and discharging the sediment at the bottom of the accommodation hole.

The method for constructing a cast-in-place pile body further comprises a step of S6: grouting the bottom of the cast-in-place pile body through the grout replenishing tube passing through the through hole.

The method for constructing a cast-in-place pile body further comprises a step of S7: grouting toward formation at a side of the cast-in-place pile body.

A method of applying the pile-bottom grouting cavity comprises cleaning the grouting pipe; and grouting into the grouting capsule.

The cleaning grouting pipe specifically comprises

S1, opening at least two of the grouting pipes connected through the first grouting portion;

S2, injecting a cleaning solution into at least one of the grouting pipes of the at least two grouting pipes in an opened state, and the cleaning liquid being discharged from the other grouting pipe in an open state which is not injected with the cleaning liquid, wherein, a pressure in the grouting pipe is less than a pressure to open the first check valve.

The grouting into the grouting capsule specifically comprises: injecting a grout into the grouting pipe in an open state, wherein, a pressure in the first grouting portion is greater than a biasing force of the first elastic member, and, the grout runs out through a gap between the first elastic member and the first grouting portion and enters the grouting capsule.

The technical solution of the present application has the following advantages:

1. The pile-bottom grouting cavity provided by the present application comprises a grouting capsule, having an expansion state in which an interior of the grouting capsule is filled with grout to bear a pile body, and a contracted state in which an interior of the grouting capsule is hollow; a grouting pipe communicating with an inner cavity of the grouting capsule for grouting the grouting capsule; and a fixing plate, provided with the grouting capsule thereon and a through hole therethrough, wherein the through hole communicates with a bottom of a accommodation hole for allowing slurry and/or sediment within the accommodation hole to pass through the through hole of the fixing plate.

By providing a through hole in the fixing plate, the slurry water, air, etc. in the accommodation hole would pass through the through hole and enter into the upper part of the pile-bottom grouting cavity when the pile-bottom grouting cavity sinks towards the bottom of the accommodation hole, and no vortex that damages the wall of the hole will be formed between the pile-bottom grouting cavity and the accommodation hole, thereby effectively avoiding the slurry water and the like to form a vortex that damages the hole wall as the slurry water cannot be discharged from the accommodation hole when the pile-bottom grouting cavity sinks, thus avoiding slurry water circling between the fixing plate edge and the accommodation hole to scour and disturb the accommodation hole wall, effectively avoiding the collapse of the accommodation hole wall, the excessive sediment at the bottom of the hole, and the problem of broken piles, which effectively improve the construction quality and progress of the cast-in-place pile body.

2. In the pile-bottom grouting cavity provided by the present application, a through hole is provided at a center of the fixing plate, and the fixing plate comprises an annular plate structure. By setting one through hole in the center of the fixing plate, the various positions of the pile-bottom grouting cavity can be relatively balanced during a sinking process, so that a position deviation of the pile-bottom grouting cavity can be avoided during the sinking process and the grouting cavity reaches the bottom of the hole smoothly.

Moreover, the above-mentioned arrangement of the through hole can reserve more space for the through hole, which can effectively increase the diameter of the through hole, thereby ensuring that slurry water and the like can pass through the through hole effectively without forming vortexes that damage the wall of the hole.

3. In the pile-bottom grouting cavity provided by the present application, the grouting capsule comprises a hollow annular structure matching the annular plate structure of the fixing plate. By designing the above structure, slurry water can effectively enter the upper part of the pile-bottom grouting cavity by passing through the grouting capsule and the fixing plate in sequence, and avoid forming a vortex that destroys the hole wall between the pile-bottom grouting cavity and the hole wall of the accommodation hole.

Moreover, because the match of the shapes of the grouting capsule and the fixing plate can effectively increase the grouting capsule volume, so that the grouting capsule can provide a fixation and support for the cast-in-place pile body, and improve the firmness and bearing capability of the cast-in-place pile body.

4. In the pile-bottom grouting cavity provided by the present application, the fixing plate is annular and provided with an annular stopper extending to an inner ring of the grouting capsule at an inner ring edge of the fixing plate.

During construction of the cast-in-place pile body, concrete needs to be poured into the rebar cage mounted with the pile-bottom grouting cavity to form a cast-in-place pile body. The above-mentioned annular stopper can effectively form a barrier between the concrete and the grouting capsule at the edge of the through hole to separate the concrete and the grouting capsule and to prevent the concrete from wrapping around the grouting capsule through the above-mentioned through hole when pouring the concrete into the rebar cage, and avoid the influence on the post grouting effect for cast-in-situ pile after the grouting capsule being wrapped by the concrete.

5. In the pile-bottom grouting cavity provided by the present application, a height value of the annular stopper is not greater than the sum of a predetermined thickness value of the sediment within the accommodation hole and a thickness of the grouting capsule, so that the pile-bottom grouting cavity is ensured to sink to a specified position. When the annular stopper abuts against the bottom of the accommodation hole, a predetermined thickness of the sediment exceeds the standard.

In addition, as the height value of the annular stopper to be less than or equal to the sum of the predetermined thickness of the sediment, after cleaning the sediment within the accommodation hole by passing through the through hole, the annular stopper abuts against the bottom of the accommodation hole, which can effectively detect whether the thickness of the sediment falls within a qualified range so that it is convenient for the construction workers to operate and ensure the construction quality.

6. In the pile-bottom grouting cavity provided by the present application, the annular stopper is perpendicular to a surface of the fixing plate, which can effectively protect the grouting capsule while ensure the slurry water in the accommodation hole will quickly pass through the through hole and enter into the upper part of the pile-bottom grouting cavity, without forming a vortex which damages the hole wall and further affects the construction quality and construction progress of the cast-in-place pile body.

7. The pile-bottom grouting cavity provided by the present application further comprises a first check valve, provided at a communication position between the grouting pipe and the grouting capsule to prevent a mixture such as sand, sediment and the like in the grouting capsule from entering the grouting pipe.

The above-mentioned first check valve can effectively prevent the mixture such as sand, sediment, etc. that enters the grouting capsule from entering the grouting pipe when the grouting capsule breaks and the pressure outside the grouting pipe is greater than the pressure inside the grouting pipe, or the grouting is interrupted due to mechanical failure, which both cause the problem of clogging of the grouting pipe, and make the pile-bottom grouting cavity unusable.

Moreover, the first check valve can effectively prevent the mixture such as sand and sediment, etc. from entering the grouting pipe, and then even if the grouting capsule is damaged before the grouting of the grouting capsule and a sediment mixture enters into the grouting capsule, a grouting can still be performed continuously towards the direction of the of grouting capsules via the grouting pipe; or in the case of grouting interruption due to mechanical failure, the grouting can be achieved repeatedly by flushing the grouting pipe in time to ensure that the tube is unblocked, which ensures the formation of the enlarged head of the pile end and an compaction effect to the surrounding formation and improves a bearing capability to the pile end.

8. In the pile-bottom grouting cavity provided by the present application, the grouting pipe is provided with a first grouting hole for allowing the grout to enter the grouting capsule, and the first check valve comprises a first elastic member oppositely disposed to the first grouting hole of the grouting pipe to seal the first grouting hole, wherein the first elastic member comprises a sealed state in which the first elastic member is in close contact with the grouting pipe to prevent the mixture such as sand and sediment from entering the grouting pipe through the first grouting hole, and an opened state in which the first elastic member is moved by a pressure from the grouting pipe in a direction away from the grouting pipe so that the grout can pass through the first grouting hole into the grouting capsule.

The first elastic member is provided at a position where the grouting pipe communicates with the grouting capsule. When the pressure in the first grouting portion is less than the sum of the contraction pressure of the first elastic member and an external pressure, the first elastic member will be pressed onto the grouting pipe under a bias pressure generated by a contraction pressure of the first elastic member to block the first grouting hole, thereby effectively preventing a mixture such as sand and sediment from entering the grouting pipe through the first grouting hole to block the grouting pipe and cause the problem that the pile-bottom grouting cavity cannot be grouted.

When the pressure in the first grouting portion is greater than the sum of the contraction pressure of the first elastic member and the external pressure, the grout runs out through the gap between the first elastic member and the first grouting portion and enters into the grouting capsule; or enters into the formation through a damaged grouting capsule. The above-mentioned deformable first elastic member can be simply and effectively used to ensure one-way grouting of the grouting pipe, so as to ensure that the mixture in the pile-bottom grouting cavity cannot enter the grouting pipe, and when the grouting capsule breaks, formation at the bottom of the pile can be reinforced by grouting to improve the bearing capacity of the pile.

9. The pile-bottom grouting cavity provided by the present application, the grouting pipe comprises a first grouting portion extending into the inner cavity of the grouting capsule, and the first grouting portion comprises an annular tube extending along an outer contour of the fixing plate, and the first elastic member comprises an annular bushing sleeved on the first grouting portion.

The above-mentioned annular first grouting portion can be effectively adapted to the annular grouting capsule, so that the first grouting portion extends to various positions of the grouting capsule, thus allowing the pile-bottom grouting cavity to achieve a more uniform grouting. The first grouting portion in the form of annular tube can be effectively wrapped by the first elastic member in the form of annular bushing, so as to ensure that the first elastic member can effectively seal the first grouting hole when the pressure inside the first grouting pipe is less than that the pressure outside the first grouting pipe, and mixture such as sand and sediment at the bottom of the hole can be prevented from entering the grouting pipe from all angles.

10. In the pile-bottom grouting cavity provided by the present application, the pile-bottom grouting cavity further comprises a grout replenishing structure communicating with the through hole for grouting into the through hole.

Grouting the pile-bottom can be performed via the through hole and through the above-mentioned grout replenishing structure, and the cement grout content at the bottom of the pile can be effectively increased, and the quality of the concrete at the bottom of the pile can be improved. Such grouting via the through hole has the following advantages: the tip and dry ballast formed by the concrete separation at the bottom pile as the concrete falls from the elongated tube, can be eliminated. The through hole can be effectively filled and the strength of the pile-bottom can be enhanced.

Pressure seepage grouting allows the water in the formation around the pile-bottom can be replaced to enhance the strength of the pile-bottom. The grout grouted into the formation around the pile-bottom via the through hole forms a grout vein and enhances the strength of the bottom of the pile.

11. In the pile-bottom grouting cavity provided by the present application, the grout replenishing structure comprises at least one grout replenishing tube which communicates with the through hole for grouting into the through hole. Through the above-mentioned grout replenishing tube, the grouting can be injected into the through hole in a simple and convenient manner from a long distance.

12. In the pile-bottom grouting cavity provided by the present application, the grout replenishing tube comprises a second grouting portion extending into a cavity of the through hole and is provided with a plurality of second grouting holes, and the second grouting portion is an arcuate tube extending along a hole wall contour of the through hole.

The above arcuate tube or annular tube with a plurality of second grouting holes can be used to effectively increase a grouting efficiency of the second grouting portion. At the same time, it can be ensured that the grout flows into the bottom formation from all directions to ensure the grouting effect.

13. In the pile-bottom grouting cavity provided by the present application, the fixing plate comprises a grout-storage chamber communicating with the through hole, and the grout replenishing tube communicates with a grout inlet of the grout-storage chamber. The grout enters into the through hole by the grout replenishing tube and the grout-storage chamber. The above-mentioned method can be used to effectively inject the grout into the through hole uniformly and stably.

14. In the pile-bottom grouting cavity provided by the present application, the grout replenishing tube is provided with a second check valve for controlling a communicating state or a cutoff state between the grout replenishing tube and the through hole, so as to prevent the mixture such as sand and sediment from entering the grout replenishing tube.

15. In the pile-bottom grouting cavity provided by the present application, the second check valve comprises: a second elastic member, oppositely disposed to the grouting hole of the grout replenishing tube to seal the second grouting hole, wherein the second elastic member comprises a sealed state in which the second elastic member is in close contact with grout replenishing tube to prevent the plugs from entering grout replenishing tube through the second grouting hole, and an opened state in which the second elastic member is moved by a pressure from the grout replenishing tube in a direction away from the grout replenishing tube so that the grout can pass through the second grouting hole into the through hole.

The above-mentioned deformable second elastic member can be simply and effectively used to ensure one-way grouting of the grouting pipe, so as to ensure that the mixture in the through hole cannot enter the grout replenishing tube.

16. The pile-bottom grouting cavity provided by the present application comprises one through hole, provided at the center of the fixing plate, wherein, the fixing plate comprises an annular plate structure, the fixing plate is provided with an annular stopper extending to an inner ring of the grouting capsule at the inner ring edge of the fixing plate, and the second grouting hole of the grout replenishing tube is located on a side of the annular stopper away from the fixing plate. Therefore, it can be ensured that the grout can effectively fill fully the hole in the middle of the inner ring of the grouting capsule by setting the second grouting hole on a side of the annular stopper away from the fixing plate, which effectively increases the cement content at the bottom of the pile-bottom grouting cavity.

17. In the pile-bottom grouting cavity provided by the present application, the grouting capsule is provided with a capsule detection port for filling a medium therein to verify whether the grouting capsule has leaked and/or a pressure level that the grouting capsule can withstand.

By filling the grouting capsule with air, water or other media through the above-mentioned capsule detection port, the pressure level that the grouting capsule can withstand will be effectively verified, and an expansion and contraction capacity and a volume size of the grouting capsule under the action of the grout can be tested.

18. In the pile-bottom grouting cavity provided by the present application, the capsule detection port is arranged on the fixing plate, which can facilitate operation of the construction contractor and reduce operation difficulty for the user.

19. In the pile-bottom grouting cavity provided by the present application, the first elastic member has a fixing portion connected with the first grouting portion and the second elastic member has a fixing portion connected with the second grouting portion respectively. The first elastic member is fixedly connected to the first grouting portion, which can effectively prevent the first elastic member from deviating from a preset position under a grouting pressure when grouting to the inner cavity of the grouting capsule through the first grouting hole, thus avoiding resulting in that the first elastic member loses the ability of sealing the first grouting hole; similarly, the above-mentioned fixing portion can also be used to effectively fix the second elastic member on the second grouting portion.

20. The cast-in-place pile body provided by the present application, comprises a pile-bottom grouting cavity; and a rebar cage, connected to the fixing plate of the pile-bottom grouting cavity and, the grouting pipe is fixedly connected to the rebar cage. Since the cast-in-place pile body comprises the pile-bottom grouting cavity of any one of the above technical solutions, therefore the cast-in-place pile body has the advantages described in any one of the above technical solutions.

21. A method for constructing a cast-in-place pile body provided by the present application, comprises the following steps: S1, forming an accommodation hole and cleaning a sediment within the accommodation hole; S2, sinking the rebar cage with the grouting cavity mounted at the bottom of the rebar cage to the bottom of the accommodation hole; S3, discharging the sediment below the fixing plate through the through hole; S4, grouting concrete into the accommodation hole to form a grouting pile; and S5, grouting into the grouting capsule to form an enlarged head at the bottom of the pile.

The above-mentioned through hole can be used by a construction contractor to effectively discharge the sediment underneath the fixing plate, thereby effectively ensuring that the thickness of the sediment within the accommodation hole falls within a qualified range, which is convenient for the construction contractor to operate the construction and the construction quality can be ensured.

22. In the method for constructing a cast-in-place pile body provided by the present application, the cast-in-place pile body further comprises a pile-side grouting pipe fixed on the rebar cage, and a first grouting hole of the pile-side grouting pipe is arranged at a position near the grouting capsule for grouting toward a pile-side formation.

By pressure grouting to the formation around side walls of the cast-in-place pile body, the formation around the pile body can be more compact with enhanced strength, and the cast-in-place pile body can be more tightly combined with the surrounding formation, which ultimately results in that the ultimate bearing capacity of the pile can be greatly improved.

23. In the cast-in-place pile body provided by the application, a negative pressure suction pipe controlled by a vacuum press is aligned to the through hole to discharge the sediment at the bottom of the accommodation hole. The negative pressure suction pipe can be used to continuously and effectively discharge the sediment and improve the sediment discharge efficiency.

24. The method for constructing a cast-in-place pile body provided by the present application further comprises a step of S6: grouting the bottom of the cast-in-place pile body through the grout replenishing tube which passes through the through hole.

Grouting the pile-bottom can be performed via the through hole and through the above-mentioned grout replenishing structure, and the cement grout content at the bottom of the pile can be effectively increased, and the quality of the concrete at the bottom of the pile can be improved. Grouting via the through hole has the following advantages:

the tip and dry ballast formed by the concrete separation at the bottom pile as the concrete falls from the elongated tube can be eliminated. The through hole can be effectively filled and the strength of the pile-bottom can be enhanced. Pressure seepage grouting allows the water in the formation around the pile-bottom to be replaced to enhance the strength of the pile-bottom. The grout grouted into the formation around the pile-bottom via the through hole forms a grout vein and enhances the strength of formation located at the bottom of the pile.

BRIEF DESCRIPTION OF THE DRAWINGS

In order to more clearly describe the technical solutions in the specific embodiments of the present invention or in the prior art, hereinafter the accompanying drawings required to be used in the description of the specific embodiments or the prior art will be briefly introduced. Apparently, the accompanying drawings described below are only directed to some embodiments of the present invention, and for those skilled in the art, without expenditure of creative labor, other drawings can be derived on the basis of these accompanying drawings.

REFERENCE SIGNS

1—accommodation hole; 2—grouting capsule; 3—grouting pipe; 4—fixing plate; 5—through hole; 6—capsule detection port; 10—annular stopper; 11—first grouting hole; 12—first elastic member; 13—grouting portion; 14—rebar cage; 15—pile-side grouting pipe; 16—grouting pipe access opening; 17—grout replenishing tube; 18—second grouting portion; 19—grout-storage chamber; 20—second grouting hole; 21—grout inlet; 22—second elastic member; 23—fixing member.

DETAILED DESCRIPTION

A clear and complete description of the technical solutions in the present invention will be given below, in conjunction with the accompanying drawings in the embodiments of the present invention. Apparently, the embodiments described below are a part, but not all, of the embodiments of the present invention. All of other embodiments, obtained by those of ordinary skill in the art based on the embodiments of the present invention without any creative effort, fall into the protection scope of the present invention.

In the description of the present invention, it needs to be noted that, the terms such as "center", "on/above", "below", "left", "right", "vertical", "horizontal", "inside", "outside" refer to the orientation or position relation based on the illustration of the drawings, and merely for facilitating and simplifying the description of the present invention, but not indicating or implying that the apparatus or components must have a specific orientation, or a specific configuration and operation. Thus, it should be understood as a limitation to the present invention. In addition, the terms such as "first", "second", "third" are merely for the purpose of description, but should not be understood as an indication or implication of relative importance.

In the description of the present invention, it needs to be noted that, unless specifically defined or restricted otherwise, terms "mount", "connection", "connect" should be broadly construed, for example, they may be fixed connection or detachable connection or integral connection; mechanical connection or electrical connection; direct connection, or indirect connection via an intermediate medium, or internal communication between two units; wireless connection or wired connection. For those skilled in the art, the specific meaning of the aforementioned terms in the present invention can be understood according to specific situations thereof.

Furthermore, the technical features which the embodiments of the present invention provided below refer to can be combined with each other as long as no conflict is constituted.

Example 1

Figure 1:
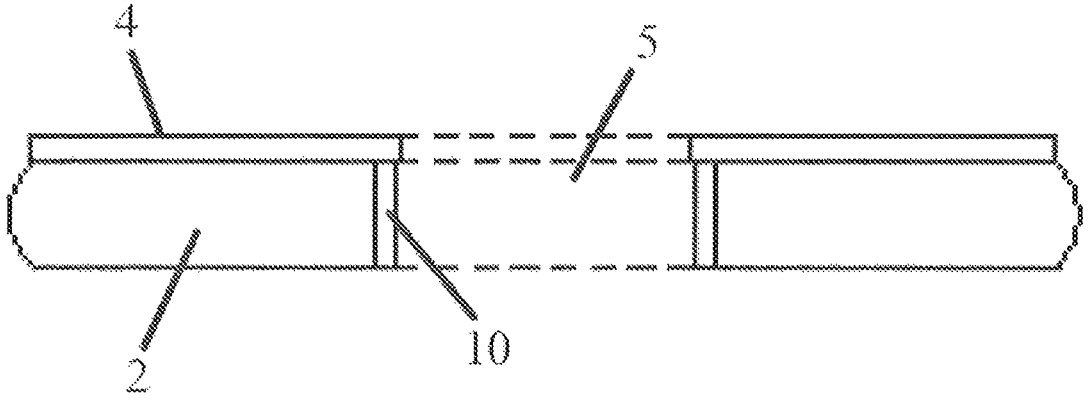
FIG. 1 is a schematic view of an internal structure of a pile-bottom grouting cavity provided by the present application.
Figure 2:
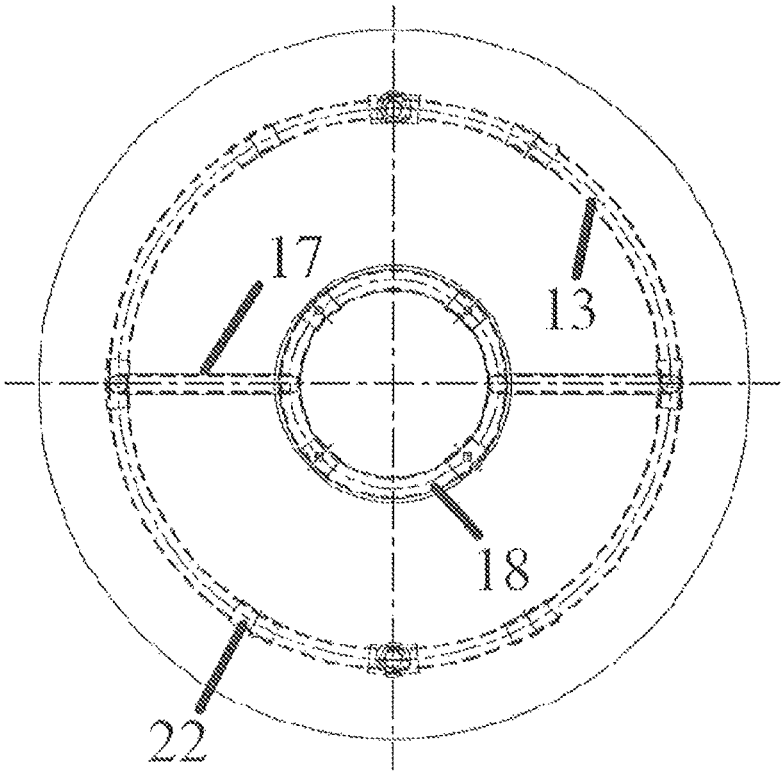
FIG. 2 is a schematic top view of an internal structure of the cast-in-place pile body provided by the application.
Figure 3:
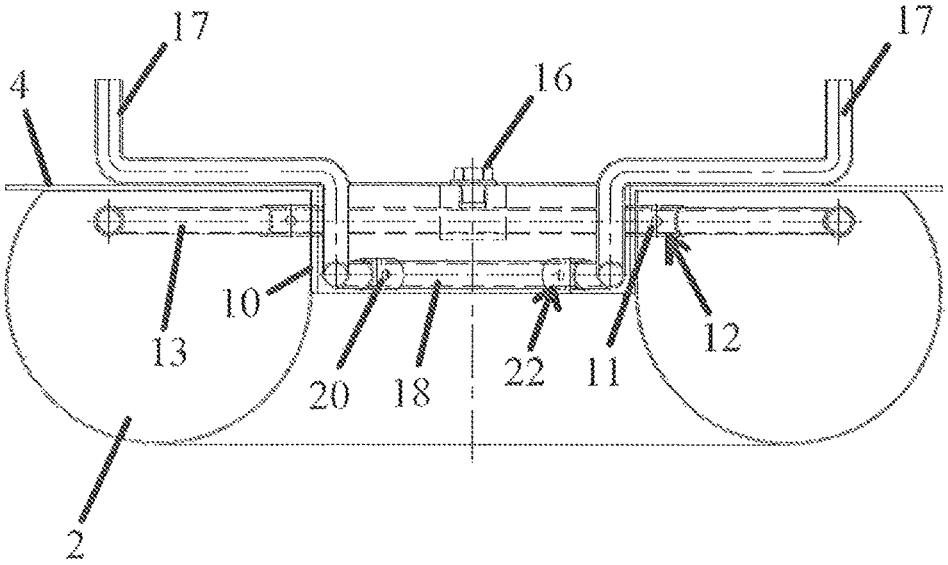
FIG. 3 is a schematic view of an internal structure of a pile-bottom grouting cavity provided with a first check valve and a second check valve according to the present application.
Figure 4:
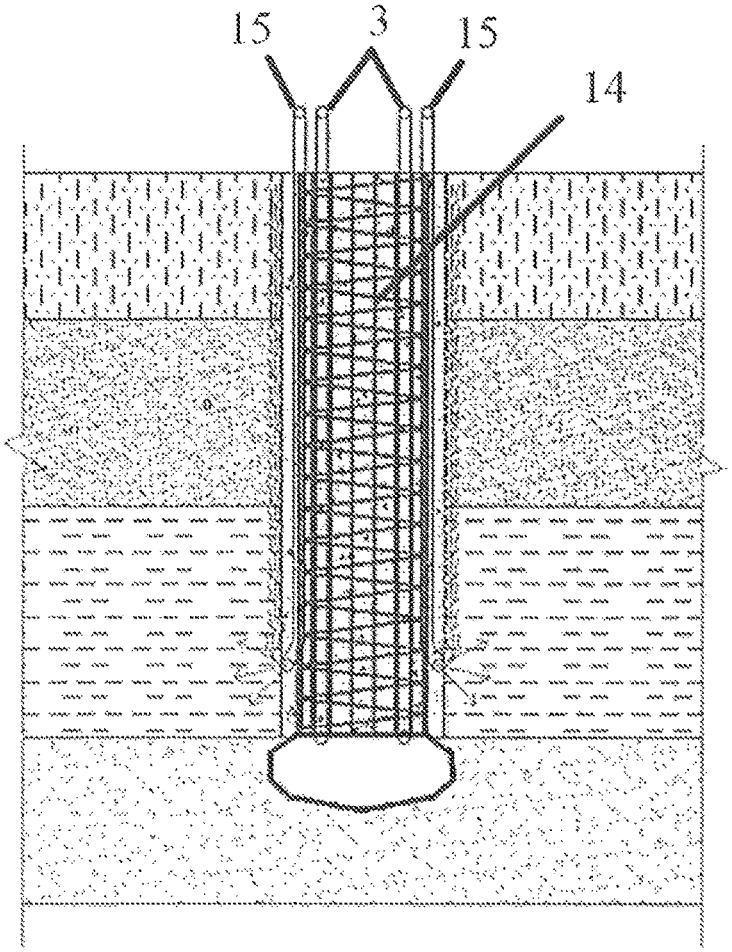
FIG. 4 is a schematic view of the construction of a cast-in-place pile body provided by the present application.
Figure 5:
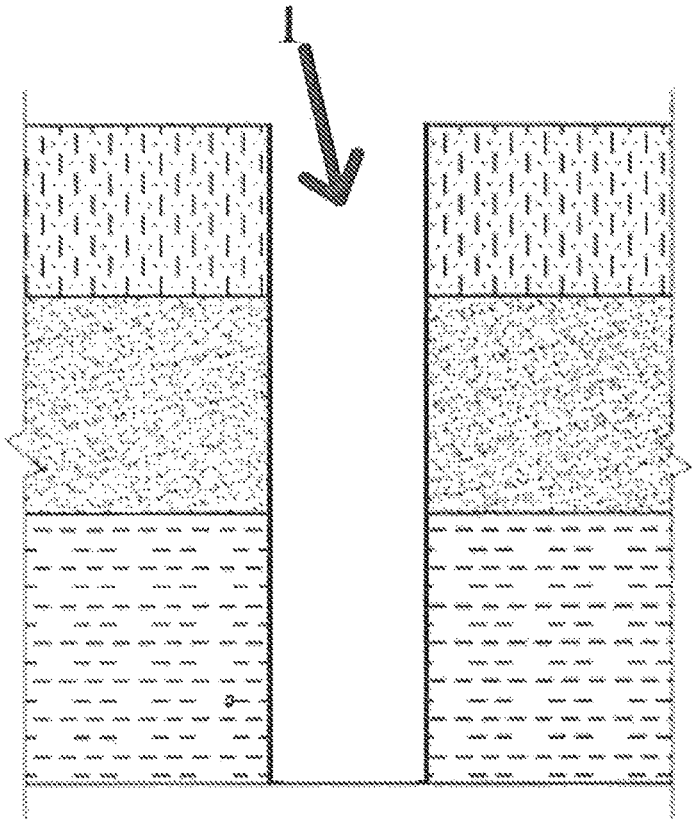
FIG. 5 is a schematic structural view of an accommodation hole provided by the present application.

The cast-in-place pile body provided in this example, as shown in FIG. 4 and FIG. 5, comprises a pile-bottom grouting cavity, as shown in FIGS. 1 to 3.

The pile-bottom grouting cavity comprises a fixing plate 4, provided with one through hole 5 which communicates with the bottom of the accommodation hole 1 to allow the slurry and sediment within the accommodation hole 1 to pass through the fixing plate 4. The through hole 5 is provided at the center of the fixing plate 4. The fixing plate 4 comprises an annular plate structure. By providing the through hole 5 in the fixing plate 4, the slurry water, air, etc. in the accommodation hole 1 will pass through the through hole 5 and enter into the upper part of the pile-bottom grouting cavity when the pile-bottom grouting cavity sinks towards the bottom of the accommodation hole 1, and no vortex that damages the wall of the hole will be formed between the pile-bottom grouting cavity and the accommodation hole 1, thereby effectively avoiding the slurry water and the like to form a vortex that damages the hole wall in the accommodation hole 1, as the slurry water cannot be discharged from the accommodation hole when the pile-bottom grouting cavity sinks, thus avoiding slurry water circling between the edge of the fixing plate 4 and the accommodation hole 1 to scour and disturb the wall of the accommodation hole 1, thereby effectively avoiding the collapse of the wall of the accommodation hole 1, the sediment at the bottom of the borehole to exceed the standard, and the problem of broken piles, which effectively improve the construction quality.

Moreover, the through hole 5 is arranged in the center of the fixing plate 4, such that various positions of the pile-bottom grouting cavity can be relatively balanced during a sinking process, therefore, position deviation of the pile-bottom grouting cavity can be avoided during the sinking process and the grouting cavity can reach the bottom of the hole smoothly.

Moreover, compared with setting a plurality of small holes, setting one through hole 5 in the center of the fixing plate 4 can reserve more space for the through hole 5, which can effectively increase the diameter of the through hole 5, so that the diameter of the through hole 5 can be effectively increased, thereby ensuring that slurry water and the like can pass through the through-holes effectively without forming vortexes that damage the wall of the hole.

The annular stopper 10 is an annular baffle provided along an inner ring edge of the fixing plate 4. The annular baffle extends to the inner ring of the grouting capsule 2 and is perpendicular to the surface of the fixing plate 4.

During construction of the cast-in-place pile body, concrete needs to be poured into the rebar cage mounted with the pile-bottom grouting cavity to form a cast-in-place pile body. The above-mentioned annular stopper 10 can effectively form a barrier between the concrete and the grouting capsule 2 at the edge of the through hole 5 to separate the concrete and the grouting capsule and to prevent the concrete from wrapping the grouting capsule 2 through the above-mentioned through hole 5 when pouring the concrete into the rebar cage, and avoid the influence on the post grouting effect for cast-in-situ pile after the grouting capsule 2 being wrapped by the concrete.

Moreover, the height value of the annular stopper 10 is not greater than the sum of a predetermined thickness of the sediment within the accommodation hole 1 and the thickness of the grouting capsule 2 to ensure that the pile-bottom grouting cavity sinks to a specified position, and then when annular stopper 10 abuts against the bottom of the hole 1, it causes a problem that the predetermined thickness of the sediment exceeds the standard.

Moreover, as the height value of the above-mentioned annular stopper 10 is less than or equal to the predetermined thickness of the sediment, after the sediment within the accommodation hole 1 is cleaned through the above-mentioned through-hole 5, the annular stopper 10 abuts against the bottom of the accommodation hole 1, which can be used to effectively detect whether the thickness of the sediment within the accommodation hole 1 is within a qualified range, so that it is convenient for the construction contractor to operate construction and ensure the construction quality.

On the other hand, the grouting capsule 2 is provided on the fixing plate 4, and the grouting capsule 2 and the fixing plate 4 enclose an accommodating cavity for containing grout. The above-mentioned fixing plate 4 can also be effectively connected with the reinforcing rebar cage to realize an installation and use of the pile-bottom grouting cavity.

A grouting capsule 2 made of rubber is provided on the fixing plate 4. The grouting capsule 2 is a hollow annular structure adapted to the fixing plate 4, and has an expansion state in which the grouting capsule 2 is filled with grout inside to bear the pile body, and a shrinking state in which an interior of the grouting capsule 2 is hollow inside. The grouting capsule 2 is designed to have the hollow annular structure that matches the fixing plate 4, so as to ensure that slurry water etc. can be effectively injected into an upper layer of the pile-bottom grouting cavity by passing through the grouting capsule 2 and the fixing plate 4 in sequence, and avoid forming a vortex that damage the hole wall between the pile-bottom grouting cavity and the hole wall of the accommodation hole 1. In addition, since the shape of the grouting capsule 2 can be adapted to the fixing plate 4, the volume of the grouting capsule 2 can be effectively increased, such that the grouting capsule 2 can provide maximum fixation and support for the cast-in-place pile body and improve the firmness of the cast-in-place pile body.

Moreover, the above-mentioned annular first grouting portion 13 can be effectively adapted to the annular grouting capsule 2, such that the first grouting portion 13 extends to different positions of the grouting capsule 2, and the grouting of the pile-bottom grouting cavity can be more uniform.

The rebar cage 14 is connected to the fixing plate 4 of the pile-bottom grouting cavity. The rebar cage 14 is further provided with a pile-side grouting pipe 15. The first grouting hole of the pile-side grouting pipe 15 is provided close to the grouting capsule 2. By pressure grouting towards the bottom of the cast-in-place pile body, the pile body and the enlarged head at the bottom of the pile are tightly combined, so that the formation around the enlarged head at the bottom of the pile and the pile-bottom are more compact with enhanced strength, and finally, the pile has a greatly improved ultimate bearing capacity. At the same time, the grouting is performed at the formation around the side wall of the pile, so that the formation around the pile body can be more compact with enhanced strength by this type of pressure grouting, and the grouting pile can be closely combined with surrounding formation, and finally, the ultimate bearing capacity of the pile can be greatly improved.

There are two grouting pipes 3 fixedly tied and connected to the rebar cage 14, and the grouting pipe 3 communicates with an inner cavity of the grouting capsule 2, and the grouting pipe 3 comprises a first grouting portion 13 extending to the inner cavity of the capsule 2 to inject grout into the grouting capsule 2.

The first grouting portion 13 comprises an annular tube extending along an outer contour of the fixing plate 4, and the annular first grouting portion 13 is provided with a first grouting hole 11 for allowing the grout to enter the grouting capsule 2 and the annular first grouting portion 13 is also provided with a first check valve for preventing mixture such as sand, sediment, etc. from entering the grouting capsule 2 and the grouting pipe 3. The first check valve comprises a first elastic member 12 oppositely disposed to the first grouting hole 11 on the grouting pipe 3 to seal the first grouting hole 11, and the first elastic member 12 comprises an annular bushing-shaped rubber member sleeved on the first grouting portion 13. The first elastic member 12 having the annular bushing structure can be used to effectively wrap the first grouting portion 13 having a tube structure to ensure that the first elastic member 12 can effectively seal the first grouting hole 11 to prevent the mixture such as sand, sediment, etc. from entering the grouting pipe 3 from every angle.

The first elastic member 12 comprises a sealed state in which the first elastic member 12 is in close contact with the grouting pipe 3 to prevent the mixture such as sand, sediment, etc. from entering the grouting pipe 3 through the first grouting hole 11, and an opened state in which the first elastic member 12 is moved by a pressure from the grouting pipe 3 in a direction away from the first grouting portion 13 so that the grout can pass through the first grouting hole 11 into the grouting capsule 2.

When the pressure in the first grouting portion 13 is less than the sum of the contraction pressure of the first elastic member 12 and an external pressure, the first elastic member 12 will be pressed onto the grouting pipe 3 under a bias pressure generated by a contraction pressure of the first elastic member to block the first grouting hole 11, thereby effectively preventing a mixture such as sand and sediment from entering the grouting pipe 3 through the first grouting hole 11 to block the grouting pipe 3 and cause the problem that the pile-bottom grouting cavity cannot be grouted.

When the pressure in the first grouting portion 13 is greater than the sum of the contraction pressure of the first elastic member 12 and the external pressure, the grout runs out through the gap between the first elastic member 12 and the first grouting portion 13 and enters into the grouting capsule 2; or enters into the formation through a damaged grouting capsule 2. The above-mentioned deformable first elastic member 12 can be simply and effectively used to ensure one-way grouting of the grouting pipe 3, so as to ensure that the mixture in the pile-bottom grouting cavity cannot enter the grouting pipe 3.

As shown in FIG. 2, a grout replenishing structure is used to grout into the through hole 5 and the inner ring space of the annular grouting capsule 2. The grout replenishing structure is two grout replenishing tubes 17, and each of the grout replenishing tube 17 comprises a second grouting portion 18 that extends into the cavity of the through hole 5 and is provided with a plurality of second grouting holes 20, and the second grouting portion comprises an annular tube extending along a hole wall contour of the through hole 5.

The above annular tube with a plurality of second grouting holes 20 can be used to effectively increase a grouting efficiency of the second grouting portion 18. At the same time, it can be ensured that the grout flows into the bottom formation from all directions to ensure the grouting effect.

The grout replenishing tube 17 is provided with a second check valve which controls a communicating state or a cutoff state between the grout replenishing tube 17 and the through hole 5. The second check valve comprises a second elastic member 22, oppositely disposed to the grouting hole 20 of the grout replenishing tube 17 to seal the second grouting hole 20, and the second elastic member 22 comprises an annular bushing sleeved on the annular second grouting portion 18. The second elastic member 22 comprises a sealed state in which the second elastic member 22 is in close contact with grout replenishing tube 17 to prevent the plugs from entering grout replenishing tube 17 through the second grouting hole 20, and an opened state in which the second elastic member 22 is moved by a pressure from the grout replenishing tube 17 in a direction away from the grout replenishing tube 17 so that the grout can pass through the second grouting hole 20 into the through hole 5.

Through the above-mentioned grout replenishing structure and via the through hole 5, the cement grout content at the bottom of the pile can be effectively increased, and the quality of the concrete at the bottom of the pile can be improved. Grouting via the through hole 5 has the following advantages:

1. the tip and dry ballast formed by the concrete separation at the bottom pile as the concrete falls from the elongated tube can be eliminated. 2. The through hole 5 can be effectively filled and the strength of the pile-bottom can be enhanced. 3. Pressure seepage grouting allows the water in the formation around the pile-bottom to be replaced to enhance the strength of the pile-bottom. 4. The grout injected into the formation around the pile-bottom via the through hole 5 forms a grout vein to enhance the strength of formation at the bottom of the pile.

In the example, one through hole 5 is arranged at the center of the fixing plate 4. The fixing plate 4 comprising an annular plate structure is provided with an annular stopper 10 extending to an inner ring of the grouting capsule 2 at an inner ring edge of the fixing plate 4. The second grouting hole 20 of the grout replenishing tube 17 is located on a side of the annular stopper 10 away from the fixing plate 4.

By setting the second grouting hole 20 on a side of the annular stopper 10 away from the fixing plate 4, it can be ensured that the grout can effectively fill fully the hole in the middle of the inner ring of the grouting capsule 2 which effectively increases the cement content at the bottom of the pile-bottom grouting cavity.

In the example, the fixing plate 4 is provided with a capsule detection port 6 for filling a medium into the grouting capsule 2 to verify whether the grouting capsule 2 has leaked and/or a pressure level that the grouting capsule 2 can withstand.

By filling the grouting capsule 2 with air, water or other media through the above-mentioned capsule detection port 6, the pressure level that the grouting capsule 2 can withstand will be effectively verified, and an expansion and contraction capacity and a volume size of the grouting capsule 2 under the action of the grout can be tested.

In the example, the first elastic member 12 has a fixing portion connected with the first grouting portion 13 and the second elastic member 22 has a fixing portion connected with the second grouting portion 18 respectively. The first elastic member 12 is fixedly connected to the first grouting portion 13 via a fixing member 23, which can effectively prevent the first elastic member 12 from deviating from a preset position under a grouting pressure when grouting to the inner cavity of the grouting capsule 2 through the first grouting hole 11, thus avoiding results in that the first elastic member 12 loses the ability of sealing the first grouting hole 11; similarly, the above-mentioned fixing portion can also be used to effectively fix the second elastic member 22 on the second grouting portion 18. The fixing member 23 is a rivet.

Certainly, in the present application, the connecting manner between the first elastic member 12 and the first grouting portion 13, and the connecting manner between the second elastic member 22 and the second grouting portion 18 are not specifically limited. In other examples, the first elastic member 12 and the first grouting portion 13, as well as the second elastic member 22 and the second grouting portion 18 can also be fixed together by bonding, buckle members or fasteners, thereby further effectively preventing the first elastic member 12 from deviating from a preset position under the action of a grouting pressure which causes the first elastic member 12 to lose the ability of sealing the grouting hole when grouting through the grouting hole 3 to the inner cavity of the grouting capsule 2.

Certainly, in the present application, the connecting manner between the first elastic member 12 and the first grouting portion 13, and the connecting manner between the second elastic member 22 and the second grouting portion 18 are not specifically limited. In other examples, the first elastic member 12 is integrally formed on the first grouting portion 13, and a telescopic gap is provided between the first elastic member 12 and the first grouting portion 13 for the grout to pass through. The second elastic member 22 and the second grouting portion 18 can also be connected together by integral molding.

The method of using the annular pile-bottom grouting cavity comprises: cleaning the grouting pipe 3 and grouting into the grouting capsule 2.

The cleaning grouting pipe specifically comprises the steps of S1, opening the two grouting pipes 3 connected through the first grouting portion 13; S2, injecting a cleaning solution into one of the two grouting pipes 3 in an opened state, and the cleaning liquid being discharged from the other grouting pipe 3 which is not injected with the cleaning liquid in an open state. The pressure in the grouting pipe 3 is less than the pressure required to open the first check valve. By using the above method, it is ensured that the first check valve is not opened, so that the cleaning liquid does not enter the grouting capsule 2, and the cleaning liquid can effectively clean the grouting pipe 3.

The grouting into the grouting capsule 2 specifically comprises: injecting a grout into the grouting pipe 3 in an open state, wherein, a pressure in the first grouting portion 13 is greater than the sum of the contraction pressure of the first elastic member 12 and the external pressure, the grout runs out through the gap between the first elastic member 12 and the first grouting portion 13 and enters into the grouting capsule 2. When a liquid circuit is not formed by a plurality of the grouting pipes 3, a liquid pressure in the grouting pipe 3 can be effectively increased, so that the pressure in the grouting pipe 3 is sufficient to open the first check valve when injecting grout to the grouting capsule 2 to ensure normal use of the pile-bottom grouting cavity.

In the present application, if a mechanical failure or other factors cause the problem of interrupting the grouting, the grouting pipe 3 can be cleaned by using the above method to ensure that the grouting pipe 3 is unblocked, and then an intermittent grouting can be repeated several times to deal with different construction situation.

The construction method of cast-in-place pile body includes the following steps:

- S1, forming an accommodation hole 1 and cleaning a sediment within the accommodation hole 1;
- S2, sinking the rebar cage 14 with the grouting cavity mounted at the bottom of the rebar cage 14 to the bottom of the accommodation hole 1;
- S3, aligning a negative pressure suction pipe to with the through hole 5 and discharging the sediment at the bottom of the accommodation hole 1.
- S4, grouting concrete into the accommodation hole 1 to form a grouting pile;
- S5, grouting into the grouting capsule 2 to form an enlarged head at the bottom of the pile.
- S6, grouting the bottom of the grouting pile through the grout replenishing tube 17 passing through the through hole 5.
- S7, grouting toward formation around the grouting pile through the pile-side grouting pipe 15.

Certainly, the structure of the first check valve is not specifically limited in the present application. In other examples, the first check valve can also be an electrically controlled valve used to remotely control opening on and closing of the first grouting hole 11.

Certainly, the connection manner for fixedly connecting the first elastic member 12 and the first grouting portion 13 is not specifically limited in the present application. In other examples, the first elastic member 12 is integrally formed on the first grouting portion 13, and a telescopic gap is provided between the first elastic member 12 and the first grouting portion 13 for the grout to pass through.

Certainly, the structure of the first elastic member 12 is not specifically limited in the present application, in other examples, the first elastic member 12 may be an irregular sheet structure fixed on the surface of the first grouting portion 13 having the tubular structure. The shape of the first elastic member 12 is adapted to an arrangement shape of the first grouting hole 11.

Certainly, the number of the grouting pipes 3 is not specifically limited in the present application. In other examples, three or more grouting pipe 3 can be used to inject grout into the first grouting portion 13, so as to ensure that an internal pressure value of the first grouting portion 13 is sufficient to open the first elastic member 12 and remove the mixture around the first elastic member 12 to ensure that the first grouting portion 13 has sufficient pressure, and ensure the grouting efficiency of the grouting pipe 3; or some of the grouting pipes 3 are started to be injected with grout to ensure that the first grouting portion 13 has sufficient pressure, and ensure the grouting efficiency of the grouting pipe 3, and other the grouting pipes 3 are closed off Certainly, the structure of the second grouting portion 18 is not specifically limited in the present application. In other examples, the second grouting portion 18 is an arcuate tube extending along the contour of the hole wall of the through hole 5.

Figure 6:
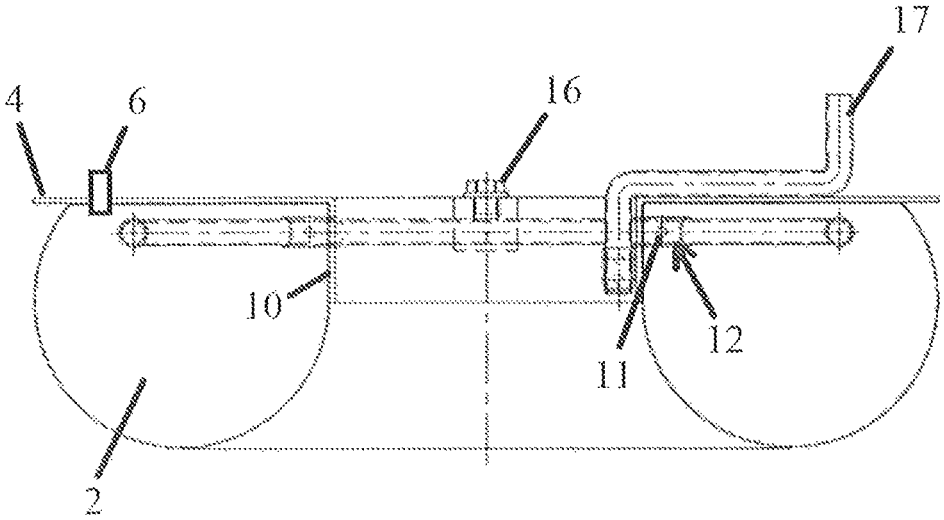
FIG. 6 is a schematic view of an internal structure of the pile-bottom grouting cavity with a single grout replenishing tube provided by the present application.

Certainly, the grout replenishing structure is not specifically limited in the present application. In other examples, as shown in FIG. 6, the number of the grout replenishing tube 17 is one or more, and the grout replenishing tube 17 passes through the through hole 5 to inject grout into an inner ring space of the grouting capsule 2 and the bottom of the pile.

Example 2

Figure 7:
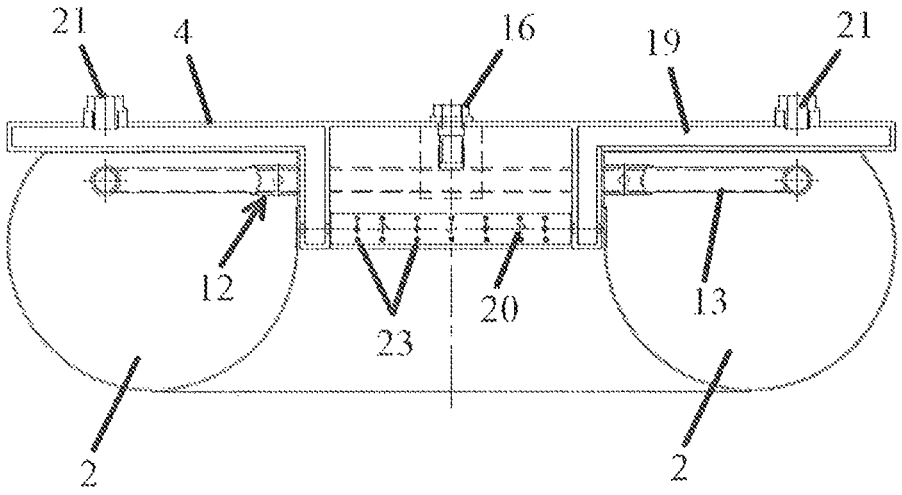
FIG. 7 is a schematic view of an internal structure of a pile-bottom grouting cavity with a grout-storage chamber by the present application.

The present example differs from Example 1 in that, as shown in FIG. 7, a grout replenishing structure is used to inject grout to the through hole 5 and an inner ring space of the annular grouting capsule 2. The grout replenishing structure is two grout replenishing tubes 17. The fixing plate 4 comprises a grout-storage chamber 19 communicating with the through hole 5, and the grout replenishing tube 17 communicates with a grout inlet 21 of the grout-storage chamber 19. The grout replenishing tube 17 is provided with a second check valve which controls a communicating state or a cutoff state between the grout replenishing tube 17 and the through hole 5.

Grouting the bottom of the pile-bottom can be performed via the through hole 5 and through the above-mentioned grout replenishing structure, and the cement grout content at the bottom of the pile can be effectively increased, and the quality of the concrete at the bottom of the pile can be improved. Grouting via the through hole has the following advantages:

1. The tip and dry ballast formed by the concrete separation at the bottom pile as the concrete falls from the elongated tube can be eliminated.
2. The through hole 5 can be effectively filled and the strength of the bottom of the pile can be enhanced.
3. Pressure seepage grouting allows the water in the formation around the bottom of the pile to be replaced with grouting to enhance the strength of the bottom of the pile.
4. The grout grouted into the formation around the bottom of the pile via the through hole 5 forms a grout vein and enhances the strength of formation located at the bottom of the pile.

Obviously, the above-described examples are only examples for clear illustration, and are not intended to limit the examples. Other variations or modifications in the various forms can be made by those skilled in the art based on the above description. There is no need and no way to exhaust all of the examples. The obvious changes or variations derived therefrom are still within the scope of protection claimed by the present disclosure.

What is claimed is:

1. A pile-bottom grouting cavity, comprising:
a grouting capsule having an expansion state in which an interior of the grouting capsule is filled with grout to bear a pile body, and a contracted state in which an interior of the grouting capsule is hollow;
a grouting pipe communicating with an inner cavity of the grouting capsule for grouting the grouting capsule; and
a fixing plate provided with the grouting capsule thereon, and a through hole therethrough, wherein the through hole communicates with a bottom of an accommodation hole for allowing slurry and/or sediment within the accommodation hole to pass through the through hole of the fixing plate; and
a grout replenishing structure, communicating with the through hole for grouting into the through hole, and/or, the grout replenishing structure comprises at least one grout replenishing tube which is communicated with the through hole for grouting into the through hole;
wherein the grout replenishing tube comprises a second grouting portion extending into a cavity of the through hole and is provided with a plurality of second grouting holes, and the second grouting portion comprises an annular pipe extending along the contour of the hole wall of the through hole; or the fixing plate comprises a grout-storage chamber communicating with the through hole, and the grout replenishing tube communicates with a grout inlet of the grout-storage chamber.

2. The pile-bottom grouting cavity according to claim 1, wherein
a through hole is provided at a center of the fixing plate;
the fixing plate comprises an annular plate structure, and/or
the grouting capsule comprises a hollow annular structure matching the annular plate structure of the fixing plate.

3. The pile-bottom grouting cavity according to claim 2, wherein
the fixing plate is annular and provided with an annular stopper extending to an inner ring of the grouting capsule at an inner ring edge of the fixing plate; and/or
a height value of the annular stopper is not greater than a sum of a predetermined thickness value of the sediment within the accommodation hole and a thickness of the grouting capsule;
and/or the annular stopper is perpendicular to a surface of the fixing plate.

4. The pile-bottom grouting cavity according to claim 1, further comprising a first check valve provided at a communication position between the grouting pipe and the grouting capsule to prevent plugs within the grouting capsule from entering the grouting pipe.

5. The pile-bottom grouting cavity according to claim 4, wherein
the grouting pipe is provided with a first grouting hole for allowing the grout to enter the grouting capsule, and
the first check valve comprises a first elastic member oppositely disposed to the first grouting hole of the grouting pipe to seal the first grouting hole, wherein the first elastic member comprises
a sealed state in which the first elastic member is in close contact with the grouting pipe to prevent the plugs from entering the grouting pipe through the first grouting hole, and
an opened state in which the first elastic member is moved by a pressure from the grouting pipe in a direction away from the grouting pipe so that the grout can pass through the first grouting hole into the grouting capsule.

6. The pile-bottom grouting cavity according to claim 5, wherein
the grouting pipe comprises a first grouting portion extending into the inner cavity of the grouting capsule,
the first grouting portion comprises an annular tube extending along an outer contour of the fixing plate, and
the first elastic member comprises an annular bushing sleeved on the first grouting portion.

7. The pile-bottom grouting cavity according to claim 1, wherein
the grout replenishing tube is provided with a second check valve which controls a communicating state or a cutoff state between the grout replenishing tube and the through hole.

8. The pile-bottom grouting cavity according to claim 7, wherein the second check valve comprises a second elastic member oppositely disposed to the grouting hole of the grout replenishing tube to seal the second grouting hole,
wherein the second elastic member comprises a sealed state in which the second elastic member is in close contact with the grout replenishing tube to prevent the plugs from entering the grout replenishing tube through the second grouting hole, and an opened state in which the second elastic member is moved by a pressure from the grout replenishing tube in a direction away from the grout replenishing tube so that the grout can pass through the second grouting hole into the through hole;

and/or, the second elastic member is an annular bushing sleeved on the second grouting portion.

9. The pile-bottom grouting cavity according to claim 1, wherein a through hole is provided at the center of the fixing plate, the fixing plate comprises an annular plate structure, the fixing plate is provided with an annular stopper extending to an inner ring of the grouting capsule at the inner ring edge of the fixing plate, and the second grouting hole of the grout replenishing tube is located on a side of the annular stopper away from the fixing plate.

10. The pile-bottom grouting cavity according to claim 1, wherein the grouting capsule is provided with a capsule detection port for filling a medium therein; and/or the capsule detection port is arranged on the fixing plate.

11. A cast-in-place pile body, comprising:

the pile-bottom grouting cavity according to claim 1; and a rebar cage connected to the fixing plate of the pile-bottom grouting cavity, wherein, the grouting pipe is fixedly connected to the rebar cage.

12. The cast-in-place pile body according to claim 11, further comprising a pile-side grouting pipe fixed on the rebar cage, wherein a first grouting hole of the pile-side grouting pipe is arranged at a position near the grouting capsule for grouting toward a pile-side formation.

13. A method for constructing the cast-in-place pile body of claim 11, comprising:

forming an accommodation hole and cleaning a sediment within the accommodation hole;

sinking the rebar cage with the pile-bottom grouting cavity mounted at the lower end of the rebar cage to the bottom of the accommodation hole;

discharging the sediment below the fixing plate through the through hole;

pouring concrete into the accommodation hole to form a grouting pile; and grouting into the grouting capsule to form an enlarged head at the bottom of the pile; and/or the discharging step comprises controlling a negative pressure suction pipe to align with the through hole, and discharging the sediment at the bottom of the accommodation hole.

14. The method according to claim 13, further comprising grouting the bottom of the cast-in-place pile body through the grout replenishing tube passing through the through hole.

15. The method according to claim 13, further comprising grouting toward a formation side of the cast-in-place pile body.

16. A method of applying the pile-bottom grouting cavity according to claim 1, comprising:

cleaning the grouting pipe; and grouting into the grouting capsule.

17. The method according to claim 16, wherein the cleaning step comprises:

opening at least two of the grouting pipes connected through the first grouting portion;

injecting a cleaning solution into at least one of the grouting pipes of the at least two grouting pipes in an opened state, and a cleaning liquid being discharged from the other grouting pipe in an open state which is not injected with the cleaning liquid;

wherein, a pressure in the grouting pipe is less than that of opening the first check valve.

18. The method according to claim 16, wherein the grouting step comprises injecting a grout into the grouting pipe in an open state, wherein, a pressure in the first grouting portion is greater than a biasing force of the first elastic member, and the grout runs out through a gap between the first elastic member and the first grouting portion and enters the grouting capsule.

* * * * *